United States Patent [19]

Navratil et al.

[11] Patent Number: 4,715,863

[45] Date of Patent: Dec. 29, 1987

[54] PROCESS FOR DYEING HYDROPHOBIC FIBRE MATERIAL FROM AQUEOUS BATH CONTAINING UNTREATED DISFERSE DYE AND TO ADJUST THE EXHAUSTED DYE BATH FOR FURTHER USE

[75] Inventors: Josef Navratil, Basel; Heinz Abel, Reinach, both of Switzerland

[73] Assignee: Ciba-Geigy Corporation, Ardsley, N.Y.

[21] Appl. No.: 861,676

[22] Filed: May 9, 1986

[30] Foreign Application Priority Data

May 14, 1985 [CH] Switzerland ..... 2049/85

[51] Int. Cl.[4] ..... D06P 3/54; D06P 5/20

[52] U.S. Cl. ..... 8/440; 8/400; 8/502; 8/504; 8/904; 8/906; 8/907; 8/908; 8/922; 8/924

[58] Field of Search ..... 8/502, 400, 440

[56] References Cited

U.S. PATENT DOCUMENTS 4,249,902 2/1981 Kruckenberg et al. ..... 8/525
4,391,606 7/1983 Kruckenberg et al. ..... 8/525

FOREIGN PATENT DOCUMENTS 143077 5/1985 European Pat. Off. .
3109954 9/1982 Fed. Rep. of Germany .
2014618 8/1979 United Kingdom .

OTHER PUBLICATIONS

Tincher, W. C., American Dyestuff Reporter, 1977 (May), 66, pp. 36–72.
Cook, F. L. and Tincher, W. C., Textile Chemist and Colorist, 1978 (Jan.), 10, pp. 21–25.
American Dyestuff Reporter, Wayne C. Tincher, "Energy Conservation in Carpet Dyeing by Dyebath Recycling" 36–72, (May 1977).
Wayne C. Tincher, "Conservation of Water, Chemicals, and Energy in Dyeing Nylon Carpet", U.S. Dept. of Commerce, National Technical Information Service PB-277 988 (Nov. 1977).
Energy Conservation in Textile and Polymer Processing, F. L. Cook and W. C. Tincher, 107, pp. 201–241 (1979).
Textile Chemist and Colorist, F. L. Cook and W. C. Tincher, "Dyebath Reuse in Batch Dyeing" pp. 21–25, (Jan. 1978) 10 (1).
Textile Chemist and Colorist, W. W. Carr and F. L. Cook, "Saving in Dyebath Reuse Depend on Variations In Impurity Concentration", pp. 106–110 (1980).

*Primary Examiner*—A. Lionel Clingman
*Attorney, Agent, or Firm*—Edward McC. Roberts; Meredith C. Findlay

[57] ABSTRACT

A process is described for dyeing hydrophobic fibre material with unfinished disperse dyes from an aqueous liquor, which comprises dissolving one or more such dyes in water at a temperature of 50° to 150° C. by means of a surfactant or surfactant mixture with a hydrotroping or solubilizing action on disperse dyes, bringing the dye solution together with the substrate in a dyeing apparatus, then heating the dyeing liquor to the dyeing temperature and completing the dyeing at that temperature and then removing the substrate and restoring the exhausted dyeing liquor to the original composition by adding water, surfactant and dye and using it again for dyeing.

23 Claims, No Drawings

PROCESS FOR DYEING HYDROPHOBIC FIBRE MATERIAL FROM AQUEOUS BATH CONTAINING UNTREATED DISPERSE DYE AND TO ADJUST THE EXHAUSTED DYE BATH FOR FURTHER USE

The present invention relates to a process for dyeing hydrophobic fibre material with unfinished disperse dyes and to the fibre material dyed by the process.

Hydrophobic fibre material, primarily polyester yarns or even woven or knitted fabrics made of polyester fibres, are dyed with disperse dyes either under atmospheric pressure, at temperatures of up to 100° C. in the presence of a carrier, or under pressure in a sealed dyeing apparatus at temperatures of 120° to 150° C. Both processes have the disadvantage that in practice they require disperse dyes which are present in an extremely finely divided and stably dispersed form. Consequently the dyes must be subjected after the synthesis to laborious grinding operations, for example in stirred ball mills, or sand mills, together with suitable dispersants. Finally, the ground disperse dye must be converted into a stable, storable liquid formulation which does not tend to reagglomerate, or be subjected to a mild drying process so as to obtain a dye powder which is rapidly dispersible in the dyeing liquor without forming lumps.

To bypass this expensive grinding and formulation process, European Patent Application No. 0,060,433 proposes an HT dyeing process for polyester piece goods which is carried out with disperse dyes which are unfinished, i.e. which are not subjected after the synthesis to any aftertreatment, in particular not to wet grinding. The significant point with this known process is that, during dyeing, the dye is mostly present in the liquor as an undissolved solid. Consequently this process is practically restricted to dyeing piece goods in jet machines. The dyeing of bobbins or wound packages in circulation apparatuses is inevitably accompanied by the undissolved dye being filtered out on the yarn or fabric.

It has now been found that, surprisingly, hydrophobic fibre material, in particular polyester and polyamide fibre material, can be dyed with unfinished disperse dyes irrespective of make-up form and dyeing apparatus if they are dissolved in water with the aid of a surfactant or surfactant mixture with a hydrotroping or solubilizing action on disperse dyes, and that after addition of consumed amounts of water, surfactant and dye the exhausted dyeing liquor can again be used for dyeing.

The process according to the invention offers considerable advantages. By using unfinished dyes, i.e. dyes which are free of dispersants, it is possible to dispense with the dispersants and with the expensive grinding, thermostabilizing and drying of dyes. The amount of waste water is much reduced, since the dyebaths are used more than once. This, in addition to saving water, leads to an appreciable reduction in energy costs, since the exhausted dyebaths do not have to be heated up again from room temperature to the dyeing temperature each time they are to be used again. Merely the cooling down which is possibly necessary in the absence of a device for the hot removal of the goods and which occurs during the change of the goods needs to be made good. Since the non-exhausted portion of the dye is again available for the next dyeing, the overall result is a smaller consumption of dye and chemicals.

Further advantages of the process according to the invention are that there are no longer any problems with dispersion stability; that the dyeing curves are very little if at all dependent on dye concentration, depending on the amount of surfactant used; and that the rate of dyeing of the dyes is more uniform and in the critical temperature range exhibits smaller values than in dyeing with conventional disperse dyes. As a result it is possible to put together trichromatic dyeing systems with good tone-on-tone build-up for any hues and depths of shade from individual components whose dyeing curves overlap instead of from primary mixtures. Level dyeings are thereby obtained within the critical temperature range even in the case of comparatively high rates of heating up and/or comparatively low rates of circulation without calculation of specific time-temperature programmes.

Further advantages over recycling the liquor when dyeing with conventional disperse dyes: Since no dispersants build up in the system, the dye concentration in the residual liquor can be determined more accurately, the reproducibility of the dyeings are (sic) not endangered and the reduced energy, water, dye and chemical consumption can be reduced even further.

The invention thus provides a process for dyeing hydrophobic fibre material with unfinished disperse dyes from an aqueous liquor, which comprises dissolving one or more such dyes in water by means of a surfactant or surfactant mixture with a hydrotroping or stabilizing action on disperse dyes at a temperature of 50° to 150° C., in particular 70°-100° C. and preferably 90°-99° C., under atmospheric or superatmospheric pressure, bringing the dye solution in contact with the substrate in a dyeing apparatus, then heating the dyeing liquor to the dyeing temperature and completing the dyeing (for example HT or carrier) at that temperature, and thereafter removing the substrate and restoring the exhausted dyeing liquor to the original composition by adding water, surfactant and dye, which can . . . (sic) either the same dye or if desired a combination of the same and another dye or only another dye, and re-using it for dyeing.

Preferably the dye liquor is used 5 to 100 times, in particular 5 to 15 times.

The disperse dyes which can be used according to the invention can belong to the most disparate dye classes. They are in particular azo, anthraquinone, nitro, methine, styryl, azostyryl, naphthoperionone, quinophthalone, acridone or naphthoquinoneimine dyes which are free of water-solubilizing groups. Preferred disperse dyes are metal-free monoazo or disazo dyes, nitro dyes, acridone dyes, anthraquinone dyes or quinophthalone dyes. Dyes which in the presence of hydrotroping or solubilizing surfactants are sufficiently water-soluble for use in the present process can be easily selected by appropriate preliminary experiments.

The dyes can categorically be used without any aftertreatment, i.e. directly from the synthesis, for example in the form of the moist press cake or even as an aqueous suspension.

The disperse dye or dyes are introduced into the dyeing apparatus in the form of a hot aqueous solution or are dissolved in the dyeing apparatus before the fibre material is introduced. The solution is to be understood hereinafter as meaning a genuine monomolecular solution, a colloidal solution and a microdispersion. The dye is thus supplied to the dyeing liquor in dissolved, solubilized, hydrotroped or microdispersed form.

The dye solution can be fed for example into the liquor circulating in the dyeing apparatus either by adding the whole solution, prepared for example in a make-up vessel connected to the dyeing apparatus, all at once or by metering in a little at a time. The latter can take place by appropriate control, for example in relation to the number of pumped cycles, or even be effected as a function of the heating up rate when the dye solution is added to the dyeing liquor a little at a time during the heating up to the dyeing temperature. It is incidentally advantageous for the dye solution which is being fed into the dyeing apparatus to have the same temperature as the circulating liquor. The process according to the invention can also be carried out by the injection method or by means of changing the direction of the liquor.

To dissolve the disperse dye (in principle it is possible to dissolve even dispersed dyes) at temperatures of 50° to 150° C. in water, use is made according to the invention of a surfactant or surfactant mixture which has a hydrotroping or solubilizing action on the dye. Primarily these surfactants are anionic, nonioni or cationic surfactants. Amphoteric surfatants are also possible. However, it is mixtures of a nonionic and an anionic surfactant which have proved particularly suitable. Mixtures of a nonionic and cationic surfactant are also possible.

The hydrotroping or solubilizing anionic surfactants used are preferably such reaction products of ethylene oxide and/or propleneocide with saturated or unsaturated fatty acids, fatty alcohols, fatty amines, alicyclic alcohols or alipathic aromatic hydrocarbons as have been esterified in the end position by an inorganic oxygen-containing acid or a polybasic carboxylic acid. These are compounds of the formula I $$R-A-(CH_2\underset{\underset{R^1}{|}}{C}HO)_m-X, \qquad (I)$$

in which R is an aliphatic hydrocarbon radical having 8 to 22 carbon atoms or a cycloaliphatic or aliphatic aromatic hydrocarbon radical having 10 to 22 carbon atoms, $R_1$ is hydrogen or methyl, A is -O-, -NH- or $$-\underset{\underset{O}{\|}}{C}-O-,$$

X is the acid radical of an inorganic oxygen-containing acid or the radical of a polybasic carboxylic acid and m is a number from 1 to 20, in particular 1 to 5. The radical R—A— is derived for example from higher alcohols such as decyl, lauryl, tridecyl, myristyl, cetyl, stearyl, oleyl, arachidyl, dyroabietyl or behenyl alcohol; also from fatty amines such strearylamine, palmitylamine or oleylamine; from fatty acids, such as caprylic, caproic, lauric, myristic, palmitic, stearic, arachidic, behenic, coconut($C_8$–$C_{18}$), decenic, dodecenic, tetradecenic, hexadecenic, oleic, linoleic, linolenic, eicosenic, docosenic or clupanodonic acid; from alkylphenols, such as butylphenols, hexylphenol, n-octylphenol, n-nonylphenol, p-tert.-octylphenol, p-tert.-nonylphenol, decylphenol, doecylphenol, tetradecylphenol or hexadecylphenol. Preference is given to radicals having 10 to 18 carbon atoms, in partiular to those which are derived from alkylphenols.

The acid radical X is generally derived from low-molecular dicarboxylic acids, for example maleic acid, malonic acid, succinic acid or sulfosuccinic acid, and is bonded to the radical $R-A-(CH_2CHR_1O)_m-$ via an ester bridge. In particular, however, X is derived from inorganic polybasic acids, such as orthophosphoric acid and sulfuric acid. The acid radical X is preferably present in salt form, i.e. for example as an alkali metal, ammonium or amine salt. Examples of such salts are sodium, potassium, ammonium, trimethylamine, ethanolamine, diethanolamine or triethanolamine salts.

These compounds are prepared by known methods by adding ethylene oxide and/or propylene oxide onto the alcohols, fatty amines, acids and alkylphenols mentioned, and then esterifying the resulting alkoxylates and if desired converting the esters into their salts. Such surfactants are known for example from U.S. Pat. No. 3,211,514.

Of this group of anionic surfactants, preference is given in turn to the use of the acid sulfuric acid esters of alkylphenol ethoxylates; that is, those compounds of the specified formula in which R—A— is an alkylphenol radical, $R_1$ is hydrogen, m is as defined above and X is a sulfuric acid radical.

Specific examples are the reaction products of 1 mole of butylphenol and 3 moles of ethylene oxide, 1 mole of tributylphenol and 5 moles of ethylene oxide, 1 mole of nonylphenol and 2 moles of ethylene oxide, 1 mole of nonylphenol and 10 moles of propylene oxide or ethylene oxide, 1 mole of nonylphenol and 20 moles of ethylene oxide, 1 mole of dodecylphenol and 4 moles of ethylene oxide or 1 mole of pentadecylphenol and 5 moles of ethylene oxide which have been esterified with sulfuric acid. The sulfuric acid half-esters of the alkoxylates mentioned are preferably present in the form of the ammonium salt. If desired it is also possible to use mixtures of the anionic surfactants.

Possible hydrotroping or solubilizing cationic surfactants are primarily quaternary ammonium compounds which have a higher alkyl radical and the formula II $$R_1-\overset{\overset{R_2}{|}}{\underset{\underset{R_2}{|}}{N^{\oplus}}}-R_3 \quad X^{\ominus} \qquad (II)$$

where the substituents $R_1$ to $R_3$ and the symbol $X^{\ominus}$ are defined as follows:

$R_1$ is a saturated and/or unsaturated alkyl radical having 8 to 22 carbon atoms;

$R_2$ is in each case and independently of the other an alkyl radical having 1 to 4 carbon atoms or a polyalkylene oxide chain having 3 to 30 ethylene oxide and/or propylene oxide units or ethylene oxide and styrene oxide units;

$R_3$ is an alkyl radical having 1 to 4 carbon atoms which can be substituted by a hydroxyl, methoxy or ethoxy group or by a carbamoyl or phenyl radical;

$X^{\ominus}$ is the anion of an organic or inorganic acid, such as a chloride, bromide, sulfate or methosulfate.

Such compounds are known or can be prepared by known methods, for example by reacting a fatty amine or a mixture of fatty amines, for example coconut amine with ethylene oxide and/or propylene oxide, and subsequently quaternizing the resulting alkoxylate, for example with dimethyl sulfate (see for example H. Stache, Tensid-Taschenbuch [Surfactants Manual]; published by Carl Hanser 1981).

The following are mentioned as examples of quaternary fatty amine alkoxylates:

adduct of 8 moles of ethylene oxide on 1 mole of tallow fat amine, quaternized with chloroacetamide;

adduct of 30 moles of ethylene oxide on 1 mole of a $C_{18}$–$C_{22}$-fat amine, quaternized with dimethyl sulfate;

adduct of 30 moles of ethylene oxide on 1 mole of laurylamine, quaternized with dimethyl sulfate;

adduct of 15 moles of ethylene oxide on 1 mole of laurylamine, quaternized with dimethyl sulfate;

adduct of 15 moles of ethylene oxide on 1 mole of stearylamine, quaternized with dimethyl sulfate;

adduct of 1 mole of styrene oxide and 30 moles of ethylene oxide on 1 mole of stearylamine, quaternized with dimethyl sulfate;

adduct of 6 moles of propylene oxide and 30 moles of ethylene oxide on 1 mole of caprylamine, quaternized with dimethyl sulfate;

adduct of 1 mole of styrene oxide and 20 moles of ethylene oxide on 1 mole of stearylamine, quaternized with dimethyl sulfate.

However, owing to their excellent solubilizing action, suitable cationic surfactants of the formula II are in particular those which in addition to the higher alkyl radical $R_1$ have as substituent $R_2$ a methyl or ethyl radical and in which $R_3$ is a phenyl-substituted alkyl radical having 1 to 4 carbon atoms; $X^{\ominus}$ is as previously defined. Also suitable are mixtures of such compounds which are obtained for example by starting in the preparation of these surfactants from fatty amine mixtures, for example coconut fat amine.

In addition to the purely anionic or cationic surfactants suitable solubilizing agents can also be amphoteric surfactants. Specific examples are the following compounds: ammonium salt of the acid monosulfuric acid ester of the adduct of 2.5 moles of ethylene oxide on 1 mole of tallow fat amine; ammonium salt of the acid monosulfuric acid ester of the adduct of 4 moles of ethylene oxide on 1 mole of tallow fat amine; ammonium salt of the acid monosulfuric acid ester of the adduct of 6 moles of ethylene oxide on 1 mole of tallow fat amine; ammonium salt of the acid monosulfuric aid ester of the adduct of 8 moles of ethylene oxide on 1 mole of tallow fat amine; quaternary ammonium salt with chloroactamide of the amphoteric sulfuric acid ester of the adduct of 8 moles of ethylene oxide on 1 mole of tallow fat amine; quaternary ammonium salt with dimethyl sulfate of the amphoteric sulfuric acid ester of the adduct of 30 moles of ethylene oxide on 1 mole of a $C_{18}$–$C_{22}$ fat amine.

Effectiveness is also exhibited by surfactants from the group of the amine oxides. Depending on the pH of the dyebath, such compounds are nonionic in character (neutral to basic liquor) or cationic (acid liquor). Examples are N-dodecyl-N,N,-dimethylamine oxide
N-myristyl-N,N-dimethylamine oxide
N-dodecyl-N,N,-di-2-hydroxyethylamine oxide
N-hexadecyl-N,N-di-2-hydroxyethylamine oxide
N-hexadecyl-N,N-dimethylamine oxide
N-oleyl-N,N-di-2-hydroxyethylamine oxide
N-steryl-N,N-di-2-hydroxyethylamine oxide
N-coconut fat acid amidopropyl-N,N-dimethylamine oxide
N-tallow fat acid amidopropyl-N,N-dimethylamine oxide.

Preferred hydrotroping or solubilizing nonionic surfactants which, as mention, are used mixed with anionic surfcants are reaction products of ethylene oxide and/or propylene oxide with (a) a Low- molecular aliphatic polyol or
(b) a saturated and/or unsaturated fatty alcolol having 6 to 20 C atoms or
(c) an alkylphenol having 4 to 12 C atoms in the alkyl radical or
(d) a hydroxybiphenyl or
(e) a saturated and/or unsaturated fatty amine having 14 to 20 C atoms or
(f) a saturated and/or unsaturated fatty acid having 14 to 20 C atoms or
(g) a saturated and/or unsaturated fatty acid (N,N-bishydroxyalkyl)amide, 2 to 10 moles, in particular 4 to 8 moles, of ethylene oxide and/or propylene oxide being present per 1 mole of the compounds mentioned under (a) to (g).

Specific examples of such alkoxylation products are:

(a) reaction products of ethylene glocol, proplene glycol, glycerol or pentaerythritol with 5 to 10 moles of ethylene oxide and/or propylene oxide per mole of polyol;
(b) reaction product of saturated and/or unsaturated fatty alcohols having 6 to 20 C atoms with 2 to 10 moles of ethylene oxide and/or 2 to 10 moles of propylene oxide per mole of fatty alcohol, preferably saturated fatty alcohols having 6 to 10 C atoms, with 2 to 10 moles of ethylene oxide per mole of fatty alcohol;
(c) reaction products of alkylphenols having 4 to 12 C atoms in the alkyl radical with 2 to 10 moles of ethylene oxide and/or 2 to 10 moles of propylene oxide per mole of phenolic hydroxyl group;
(d) reaction products of o-, m- or p-phenylphenol with 2 to 10 moles of ethylene oxide and/or propylene oxide per mole of 1 hydroxybiphenyl;
(e) reaction products of saturated and/or unsaturated fatty amines having 14 to 20 C atoms with 2 to 10 moles of ethylene oxide and/or 2 to 10 moles of propylene oxide per mole of fatty amine;
(f) reaction products of saturated and/or unsaturated fatty acids having 14 to 20 C atoms with 2 to 10 moles of ethylene oxide and/or 2 to 10 moles of propylene oxide per mole of fatty acid;
(g) reaction products of saturated and/or unsaturated fatty acid (N,N-bis-hydroxyalkyl)amides, for example coconut oil fatty acid (N,N-bis- -hydroxyethyl)amide with 2 to 10 moles of ethylene oxide and/or propylene oxide per mole of fatty acid hydoxyalkylamide (sic).

Mixtures of the reaction products as per (a) to (g) with one another can also be used. These mixtures are obtained by mixing individual reaction products or directly by alkylating a mixture of the parent compounds of the reaction products.

Suitable saturated and/or unsaturated fatty alcohols for (b) are dodecanol, hexadecyl alcohol, palmityl alcohol, stearyl alcohol, oleyl alcohol or tallow fat alcohols, hexanol, 2-ethylhexanol and decanol.

Alkylphenols for (c) are n-butylphenol, tert.-butylphenol, tributylphenol, octylphenol, p-amylphenol, hexalphenol (sic), isooctylphenol, nonylphenol and dodecylphenol.

Suitable fatty amines for (e) are for example in addition to stearylamine, palmitylamine and in particular oleylamine.

Saturated and/or unsaturated fatty acids for (f) are for example palmitic acid, especially stearic acid and oleic acid.

Particularly effective reaction products come from groups (c) and (d) and are in particular hydroxybiphenyl ethoxylates, for example reaction products of 6 or 8 moles of ethylene oxide with 1 mole of o-phenylphenol, and $C_4$ to $C_9$ alkylphenol ethoxylates, for example reaction products of 6 to 8 moles of ethylene oxide with 1 mole of butylphenol.

The ethylene/propylene oxide reaction products are known or can be prepared by methods known per se (see for example: N. Schonfeldt, Grenzflachenaktive Aethylenoxid-Addukte [Surface-active ethylene oxide adducts]; Wissenschaftliche Verlagsgesellschaft mbH, Stuttgart; 1976).

The mixing ratio of nonionic to anionic surfactant advantageously varies between 1:4 and 4:1. And preference is given to using those surfactant mixtures which contain about twice as much nonionic surfactant as anionic surfactant.

A particularly pronounced solubilizing action is possessed by a mixture which contains as nonionic component a reaction product of 1 mole of o-phenylphenol or 1 mole of tert.-butylphenol and 6 moles of ethylene oxide and as anionic component a nonylphenol diglycol ether sulfate; and by a mixture of a cationic and a nonionic surfactant, for example a reaction product of 1 mole of o-phenylphenol +6 moles of ethylene oxide and a product of the formula

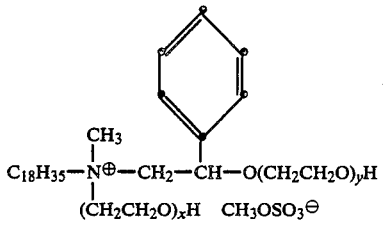

$x + y$ = approx. 15

As regards the amount o surfactant or surfactant mixture, 5 to 100, preferably 10 to 80, and in particular 25 to 45, parts of surfactant or surfactant mixture are used per 1 part of disperse dye.

The amounts in which the disperse dyes are used can vary within wide limits depending on the desired depth of shade. In general amounts of 0.01 to 10 per cent by weight, on weight of fibre, of one or more of the disperse dyes mentioned are used.

The hydrophobic fibre materials which are dyeable by the present process are primarily those which are composed of linear high-molecular esters of aromatic polycarboxylic acids with polyfunctional alcohols, for example from terephthalic acid and ethylene glycol or dimethylolcyclohexane and copolymers of terephthalic acid and isophthalic acid and ethylene glycol. These materials, provided suitable apparatus is available, can be present in any desired processed state, for example in the form of loose fibre, slubbing, yarn, textured filaments, woven or knitted fabrics, as well as blend fabrics with one another or with other fibres, for example as blend fabrics of polyester/polyamide or polyester/cotton. The dyeing temperature for these materials is preferably 120° to 150° C. for the HT method and up to 100° C. for the carrier method.

The process according to the invention can also be used to dye polyamide material, for example nylon-6, nylon-6.6 or even nylon 12. The dyeing temperature for these materials is preferably 98° to 100° C.

If necessary, the aqueous liquor can contain customary dyeing assistants, advantageously in small amounts, such as acids, in particular an organic lower monocarboxylic acid, for example formic acid or acetic acid, buffer salts, such as ammonium sulfate or sodium acetate, wetting agents, emulsifiers or anti-foams.

The liquor ratio is customarily 5:1 to 50:1; the dyeing time ranges from 5 to 60 minutes.

The process according to the invention is preferably carried -out in circulation apparatus as follows: The unfinished dye or dyes are presented as an aqueous suspension, as a press cake or even in solid form, for example in powder form, in a make-up vessel connected to the dyeing apparatus and are dissolved or solubilized in hot water at about 50° to 150° C., for example by means of a mixture of nonionic and anionic surfactant. By addition of acetic acid and sodium acetate the dye solution is brought to pH 4–5.5. Thereafter, by opening a valve, the dye solution, if necessary after passing through a filter, is led into the dyeing apparatus, where the polyester material to be dyed is present for example in the form of a wound package, for example as muff, cross-wound package or beam, or as an endless piece of cloth. If necessary, the substrate is preheated with steam. With continued constant liquor circulation advantageously from in to out or even alternatingly, for example at 5 minute intervals, the dyebath is heated up to a temperature of 120° to 150° C., advantageously 125° to 135° C. at a rate of about 1° C./minute. On obtaining the desired depth of shade or on complete exhaustion of the dyebath —dyeing time about 1 hour—the hot liquor is cooled down sufficiently for the textile material to be removed from the liquor and the portion of the liquor which is carried out to be reduced to less than 1% (based on the liquor as a whole), for example by squeezing off or centrifuging. By weighing the wet textile material the amount of consumed dyeing liquor is determined, and the liquor remaining in the dyebath is replenished with the corresponding amount of water and surfactant.

The dye content of the residual liquor is determined in conventional manner, preferably photometrically, and sufficient dye is subsequently added to the residual liquor to obtain the liquor composition required for the next dyeing. It is then possible to repeat the dyeing cycle described above.

The examples below serve to illustrate the invention; parts and percentages are by weight. The temperatures are given in degreees centigrade.

EXAMPLE 1

In the metal pot of a laboratory dyeing apparatus (Callebaut de Blicquy), 28.44 mg of the unfinished dye of the formula

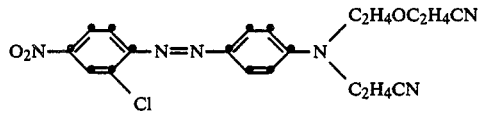

are dissolved at 98° C. in 100 ml of an aqueous liquor which contains 1 ml (1.08 g) of a surfactant solution which consists of 42.7% of the reaction product of mol of o-phenylphenol +6 ml of ethylene oxide,
42.7% of nonylphenol diglycol ether sulfate as a 40% aqueous solution,
14.2% of water and
0.4% of antifoam.

The dye solution is brought to pH 4.6-5 by adding ammonium sulfate and formic acid and the liquor is then entered with 10 g of polyester fabric (Crimplene®), and the metal pot is closed. The temperature is raised to 130° C. in the course of 6 minutes and is maintained there for 30 minutes. The temperature is then reduced to below 100°, and the substrate is removed from the liquor.

The amount of dyeing liquor which is being carried out is determined as 28.44 g by weighing the moist substrate; the residual dyeing content in the exhausted dye liquor is determined photometrically (2.46 mg).

The exhausted dye liquor is then replenished with as much water (28.25 g) and surfactant (0.184 g) as was removed in the residual liquor which was carried out. Moreover, sufficient dye is added to restore the original content of 28.44 mg.

This dye liquor is entered again with 10 g of polyester fabric, and the dyeing process described above is repeated. This is carried out a total of 10 times.

The dyeings obtained are level and practically identical in depth of shade. The total degree of exhaustion in terms of dye after 10 dyeings was above 96%.

Table 1 below shows the respective starting and replenished amounts of water, dye and surfactant and the photometrically determined relative depth of shade of the dyeings obtained, based on the first dyeing.

TABLE 1

| Experiment number | starting or replenished amount of dye | residual liquor carried out: water [g] | residual liquor carried out: dye [mg] | residual liquor carried out: surfactant [g] | dye in residual liquor left behind | amount to be replenished: water [g] | amount to be replenished: dye [mg] | amount to be replenished: surfactant [g] | relative depth of shade of the dyeing obtained |
|---|---|---|---|---|---|---|---|---|---|
| 1 | 28,44 | 28,25 | 0,97 | 0,184 | 2,46 | 28,25 | 25,98 | 0,184 | 100 |
| 2 | 25,98 | 29,10 | 0,93 | 0,189 | 2,26 | 29,10 | 26,18 | 0,189 | 106 |
| 3 | 26,18 | 29,40 | 0,94 | 0,191 | 2,26 | 29,40 | 26,18 | 0,191 | 101 |
| 4 | 26,18 | 28,40 | 0,92 | 0,185 | 2,31 | 28,40 | 26,13 | 0,185 | 103 |
| 5 | 26,13 | 28,30 | 0,89 | 0,184 | 2,26 | 28,30 | 26,18 | 0,184 | 105 |
| 6 | 26,18 | 29,00 | 0,94 | 0,189 | 2,30 | 29,00 | 26,14 | 0,189 | 104 |
| 7 | 26,14 | 28,30 | 0,85 | 0,184 | 2,16 | 28,30 | 26,28 | 0,184 | 103 |
| 8 | 26,28 | 28,40 | 0,88 | 0,185 | 2,21 | 28,40 | 26,23 | 0,185 | 104 |
| 9 | 26,23 | 28,20 | 0,89 | 0,183 | 2,27 | 28,20 | 26,17 | 0,183 | 102 |
| 10 | 26,17 | 28,90 | 0,90 | 0,188 | 2,21 | 28,90 | 26,23 | 0,188 | 101 |

EXAMPLE 2

In the metal pot of a laboratory dyeing apparatus (Callebaut de Blicquy), 22.29 mg of the dried-our press cake of the dye of the formula

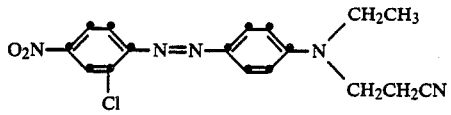

are dissolved at 98° C. 100 ml of an aqueous liquor which contains 1.2 ml (1.3 g) of a surfactant solution (60% active substance) which consists of
42.7% of the reaction produt of 1 mol of o-phenylphenol+6 mol of ethylene oxide,
42.7% of nonylphenol diglycol ether sulfate as a 40% aqueous solution,
14.2% of water and
0.4% of antifoam.

The dye solution is brought to pH 4.6-5 by adding ammonium sulfate and formic acid and the liquor is then entered with 10 g of polyester fabric (Crimplene®), and the metal pot is closed. The temperature is raised to 130° C. in the course of 6 minutes and is maintained there for 30 minutes. The temperature is then reduced to below 100° C., and the substrate is removed from the liquor.

The amount of dyeing liquor which is being carried out is determined by weighing the moist substrate; the residual dyeing content in the exhausted dye liquor is determined photometrically (see Table 2).

The exhausted dye liquor is then replenished with as much water and surfactant as was removed in the residual liquor which was carried out. Moreover, sufficient dye is added to restore the original content (see Table 2).

This dye liquor is entered again with 10 g of polyester fabric, and the dyeing process described above is repeated. This is carried out a total of 10 times.

The dyeings obtained are level and practically identical in depth of shade.

Table 2 below shows the respective starting and replenished amounts of water, dye and surfactant and the photometrically determined relative depth of shade of the dyeings obtained, based on the first dyeing.

TABLE 2

| Experiment number | starting or replenished amount of dye | residual liquor carried out: water [g] | residual liquor carried out: dye [mg] | residual liquor carried out: surfactant [g] | dye in residual liquor left behind | amount to be replenished: water [g] | amount to be replenished: dye [mg] | amount to be replenished: surfactant [g] | relative depth of shade of the dyeing obtained |
|---|---|---|---|---|---|---|---|---|---|
| 1 | 22,29 | 28,1 | 0,207 | 0,219 | 0,53 | 28,1 | 21,76 | 0,219 | 100 |
| 2 | 21,76 | 28,4 | 0,226 | 0,222 | 0,57 | 28,4 | 21,72 | 0,222 | 100 |
| 3 | 21,72 | 28,1 | 0,203 | 0,219 | 0,52 | 28,1 | 21,77 | 0,219 | 102 |
| 4 | 21,77 | 28,1 | 0,207 | 0,219 | 0,53 | 28,1 | 21,76 | 0,219 | 102 |
| 5 | 21,76 | 27,2 | 0,217 | 0,212 | 0,58 | 27,2 | 21,71 | 0,212 | 100 |

TABLE 2-continued

| Experiment number | starting or replenished amount of dye | residual liquor carried out: water [g] | residual liquor carried out: dye [mg] | residual liquor carried out: surfactant [g] | dye in residual liquor left behind | amount to be replenished: water [g] | amount to be replenished: dye [mg] | amount to be replenished: surfactant [g] | relative depth of shade of the dyeing obtained |
|---|---|---|---|---|---|---|---|---|---|
| 6 | 21,71 | 27,8 | 0,200 | 0,217 | 0,52 | 27,8 | 21,77 | 0,217 | 102 |
| 7 | 21,77 | 27,9 | 0,201 | 0,218 | 0,52 | 27,9 | 21,77 | 0,218 | 102 |
| 8 | 21,77 | 27,1 | 0,204 | 0,211 | 0,55 | 27,1 | 21,75 | 0,211 | 102 |
| 9 | 21,75 | 27,8 | 0,208 | 0,217 | 0,54 | 27,8 | 21,75 | 0,217 | 102 |
| 10 | 21,75 | 27,9 | 0,209 | 0,218 | 0,54 | 27,9 | 21,75 | 0,218 | 103 |

EXAMPLES 3-7

The resulting dyeings are level and the respective repeats are practically identical in depth of shade.

TABLE 3

| No. | Substrate | Dye: Formula | Starting amount [mg] | Surfactant (concentration in the liquor) |
|---|---|---|---|---|
| 3 | PES | 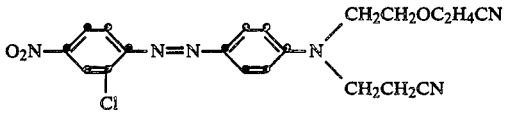 | 28,29 | Nonylphenol diglycol ether sulfate (30 g/l) |
| 4 | PES | 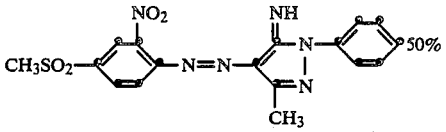 50% 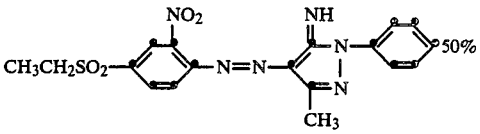 50% | 28,70 | 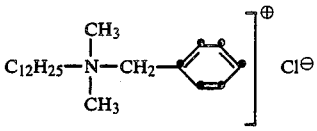 (20 ml/l) |
| 5 | PES | 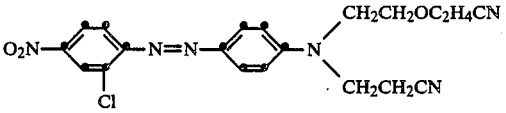 | 28,44 | 42,7% of reaction product of 1 mol of o-phenylphenol + 6 mol of ethylene oxide 42.7% of nonylphenol glycol ether sulfate as 40% aqueous solution 14.2% of water and 0.4% of antifoam (13 ml/l) |
| 6 | PES | 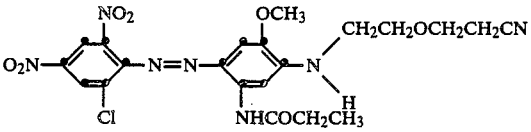 67% 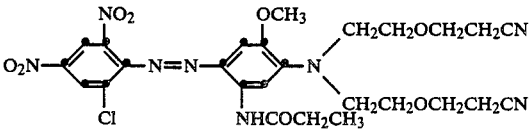 33% | 25,62 | 42,7% of reaction product of 1 mol of o-phenylphenol + 6 mol of ethylene oxide 42.7% of nonylphenol diglycol ether sulfate as 40% aqueous solution 14.2% of water and 0.4% of antifoam (20 ml/l) |
| 7 | PES | 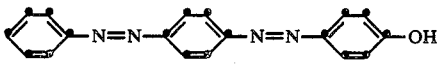 | 53,01 | 42,7% of reaction product of 1 mol of o-phenylphenol + 6 mol of ethylene oxide 42.7% of nonylphenol diglycol ether sulfate as 40% aqueous solution 14.2% of water and 0.4% of antifoam (18 ml/l) |

Number of successive dyeings: No.s 3 and 4: 3; No. 5: 20; No.s 6 and 7: 10.

In examples 3-7 polyester material (PES) was dyed by the same method and under the same conditions as in Example 2. Dye (dried-out press cakes), starting amount of dye, surfactant, surfactant concentration and number of dyeings can be taken from Table 3.

EXAMPLE 8

Example 2 is repeated analogously. 22.29 mg of the dye of the formula

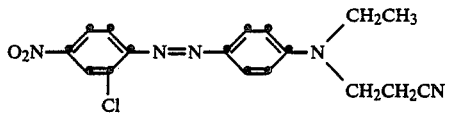

are dissolved at 78° C. in 100 ml of an aqueous liquor which contains 5 g/l of a carrier obtained by mixing dodecylbenzenesulfonic acid, triethanolamine, diphenyl, Uniperol EL, xylene, n-hexanol and ethylene glycol at 60° C. into 1,2,4-trichlorobenzene. After adjustment of the pH (see Example 2) the liquor temperature was raised to 100° C. in the course of 1 minute. The polyester substrate was dyed at 100° C. for 60 minutes. The result obtained is polyester material dyed a level red.

EXAMPLE 9

Example 2 is repeated analogously. 10 mg of the dye of the formula

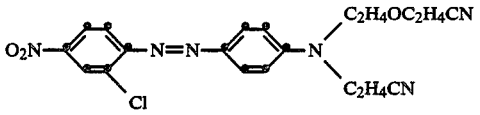

are dissolved at 98° C. 100 ml of an aqueous liquor which contains 10 ml/l of a surfactant composed of 42.7% of the reaction product of 1 mol of o-phenylphenol +6 mol of ethylene oxide, 42.7% of nonylphenol diglycol ether sulfate as a 40% aqueous solution, 14.2% of water and 0.4% of antifoam.

After adjustment of the pH (see Example 2) the liquor temperature was raised to 100° C. in about 1 minute. The nylon 6.6 substrate was dyed at 100° C. for 45 minutes. The result obtained is nylon material dyed a level scarlet.

We claim:

1. A process for dyeing hydrophobic fibre material with unformulated disperse dyes from an aqueous liquor containing a solubilizingly or dispersingly effective amount of surfactant or surfactant mixture having a hydrotropic action on disperse dyes, which process comprises dissolving one or more such dyes in water at a temperature of 50° to 150° C. by means of said surfactant or surfactant mixture, bringing the dye solution together with the substrate in a dyeing apparatus, then heating the dyeing liquor to the dyeing temperature, completing the dyeing at that temperature, then removing the substrate, restoring the exhausted dyeing liquor to the composition required for the next dyeing by adding water and surfactant in amounts corresponding to the amounts used in the previous dyeing and the same or different dye, and dyeing further substrate.

2. A process as claimed in claim 1, wherein the dye solution is injected or metered into the dyeing apparatus.

3. A process as claimed in claim 1, wherein the surfactant is a nonionic, anionic or a cationic surfactant or a mixture of a nonionic and an anionic surfactant or of a nonionic and a cationic surfactant.

4. A process as claimed in claim 3, wherein a mixture of a nonionic and an anionic surfactant is used.

5. A process as claimed in claim 3, wherein the anionic surfactant used is an anionic surfactant of the formula I $$R-A-(CH_2\underset{\underset{R^1}{|}}{C}HO)_m-X, \qquad (I)$$

in which R is an aliphatic hydrocarbon radical having 8 to 22 carbon atoms or a cycloalihatic or aliphatic aromatic hydrocarbon radical having 10 to 22 carbon atoms, $R_1$ is hydrogen or methyl, A is —O—, —NH— or $$-\underset{\underset{O}{\|}}{C}-O-,$$

X is the acid radical of an inorganic oxygen-containing acid or the radical of a polybasic carboxylic acid, and m is a number form 1 to 20.

6. A process as claimed in claim 5, wherein the acid sulfuric acid ester of an alkylphenol ethoxylate is used.

7. A process as claimed in claim 3, wherein the cationic surfactant used is quaternary ammonium compounds of the formula II $$R_1-\overset{\overset{R_2}{|}}{\underset{\underset{R_2}{|}}{N}}{}^{\oplus}-R_3 \quad X^{\ominus} \qquad (II)$$

in which $R_1$ is a saturated and/or unsaturated alkyl radical having 8 to 22 carbon atoms, $R_2$ is in each case independently of each other an alkyl radical having 1 to 4 carbon atoms or a polyalkylene oxide chain having 3 to 30 ethylene oxide and/or propylene oxide units or ethylene oxide and styrene oxide units;

$R_3$ is an alkyl radical having 1 to 4 carbon atoms which can be substituted by a hydroxyl, methoxy or ethoxy group or by a carbamoyl or phenyl radical;

$X^{\ominus}$ is the anion of an organic or inorganic acid.

8. A process as claimed in claim 7, wherein the cationic surfactant of the formula II used is such a surfactant in which $R_2$ is methyl or ethyl, $R_3$ is phenyl-substituted alkyl $C_1$ to $C_4$ and $R_1$ and $X^{\ominus}$ are as defined in claim 7.

9. A process as claimed in claim 3, wherein the nonionic surfactant used is a reaction product of ethylene oxide and/or propylene oxide with (a) a low-molecular aliphatic polyol or (b) a saturated and/or unsaturated fatty alcohol having 6 to 20 C atoms or (c) an alkylphenol having 4 to 12 C atoms in the alkyl radical or (d) a hydroxybiphenyl or (e) a saturated and/or unsaturated fatty amine having 14 to 20 C atoms or (f) a saturated and/or unsaturated fatty acid having 14 to 20 C atoms or (g) a saturated and/or unsaturated fatty acid (N,N-bis-hydroxyalkyl)amide, 2 to 10 moles, in particular 4 to 8 moles, of ethylene oxide and/or propylene oxide being used per 1 mole of the compounds mentioned under (a) to (g).

10. A process as claimed in claim 9, wherein a reaction product of ethylene oxide with a hydroxybiphenyl or with a $C_4$ to $C_9$ alkylphenol is used.

11. A process as claimed in claim 4, wherein the nonionic surfactant used is a reaction product of 1 mole of o-phenylphenol or 1 mole of tert.-butylphenol with 6 moles of ethylene oxide in each case and the anionic surfactant used is a nonylphenol diglycol ether sulfate.

12. A process as claimed in claim 3, wherein the nonionic surfactant used is a reaction product of 1 mole of o-phenylphenol+6 moles of ethylene oxide and the cationic surfactant used is such a surfactant of the formula

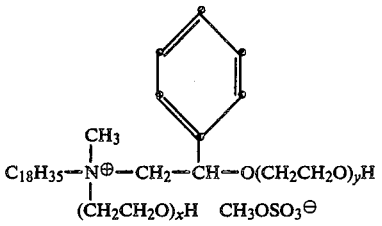

$x + y$ = approx. 15

13. A process as claimed in claim 1, wherein 10 to 80 parts of surfactant or surfactant mixture are used to 1 part of dye.

14. A process as claimed in claim 13, wherein 25 to 45 parts of surfactant or surfactant mixture are used to 1 part of dye.

15. A process as claimed in claim 4, wherein nonionic and anionic surfactant is used in a ratio of 1:4 to 4:1, in particular 2:1.

16. A process as claimed in claim 1, wherein the disperse dyes used are metal-free monoazo or disazo dyes, nitro dyes, acridone dyes, anthraquinone dyes or quinophthalone dyes.

17. A process as claimed in claim 1, wherein the hydrophobic fibre material used is polyester material.

18. A process as claimed in claim 1, wherein the exhausted dyeing liquor is used 5 to 100 times, after addition each time of water, surfactant, dye and chemicals to restore the composition required for the next dyeing.

19. A process as claimed in claim 1, wherein the dye content in the residual liquor is determined photometrically.

20. A process as claimed in claim 1, wherein polyester material is dyed at 100° to 150° C.

21. A process as claimed in claim 1, wherein material made of synthetic polyamide is dyed at 98° to 100° C.

22. A process according to claim 17, wherein the hydrophobic fiber material is made of polyethylene glycol terephthalate fibers.

23. A process according to claim 18, wherein the exhausted dyeing liquor is used 5 to 15 times.

* * * * *